United States Patent [19]

Erlenbach

[11] 3,985,203

[45] Oct. 12, 1976

[54] LADDER LANDING

[76] Inventor: Walter Erlenbach, 133 Curry St., Richmond, Calif. 94801

[22] Filed: Oct. 2, 1975

[21] Appl. No.: 619,023

[52] U.S. Cl. ..... 182/120; 248/210

[51] Int. Cl.[2] ..... E06C 7/14

[58] Field of Search ..... 182/120, 121, 214; 248/210, 238, 235

[56] References Cited

UNITED STATES PATENTS

| | | | |
|---|---|---|---|
| 666,099 | 1/1901 | Kepler | 248/210 |
| 2,837,306 | 6/1958 | Elm | 248/210 |
| 3,318,415 | 5/1967 | Christie | 182/214 |
| 3,495,683 | 2/1970 | Broden | 248/210 |
| 3,784,139 | 1/1974 | Ellis | 248/210 |
| 3,822,847 | 7/1974 | Emmons | 248/210 |

*Primary Examiner*—Reinaldo P. Machado
*Attorney, Agent, or Firm*—Harris Zimmerman

[57] ABSTRACT

A landing for a ladder or the like includes a support bracket adapted to be secured to the upper end of a ladder by a tie bar passing through a rung thereof. The bracket includes a bar rigidly disposed in the channel cavity of the ladder rail, and a support beam extending laterally from the bar outwardly from the side of the ladder. A plate is disposed horizontally with one edge adapted to rest on a roof or sill surface of the structure on which the ladder is leaning, with a medial portion of the plate resting on the support beam. The plate provides a safe egress from the top of the ladder to the roof or sill.

2 Claims, 5 Drawing Figures

LADDER LANDING

BACKGROUND OF THE INVENTION

Among those individuals who commonly use ladders in their work, it is well known that most accidents associated with the use of ladders occur when the individual is disembarking from the top of the ladder to a roof, building, or the like. This dangerous situation is due to the fact that the individual must step around the portion of the ladder which extends above the surface onto which the individual is progressing. This process involves swinging one's weight to the outside of the ladder with one foot on the ladder and the other on the roof. Should either footing fail, or should the ladder slip laterally, there is no margin of safety, and a serious accident results.

A search of the prior art reveals a paucity of apparatus to alleviate this situation. The prior art includes the following United States Patents:

| | |
|---|---|
| 2,881,028 | 1959 |
| 2,051,060 | 1936 |
| 1,658,753 | 1928 |
| 1,245,958 | 1917 |
| 1,142,806 | 1915 |
| 929,291 | 1909 |

In this prior art the only apparatus designed for disembarking a ladder safely is a platform which is secured to the upper ends of the ladder rails. This construction is inherently difficult to use, since the ladder must be a particular length to lean against a building at the proper angle with the upper end flush with the roof.

The other patents which comprise the prior art generally disclose shelf arrangements which are variously secured to the side of the ladder. These structures are designed to support tools and paint containers or the like, and are structurally insufficient to support the weight of a person.

SUMMARY OF THE INVENTION

The present invention generally comprises a landing assembly which is removably secured to a ladder to facilitate disembarking therefrom to a roof surface or the like. It includes a landing plate which extends horizontally at the side of the ladder, and a bracket which is secured to one of the side rails of the ladder. The bracket includes a bar which is adapted to be received within the channel cavity of the ladder rail and secured thereat by a tie bar which passes through a rung of the ladder and is secured by a nut adjacent to the other side rail. The bracket is provided with a support beam welded at one end to the bar and extending laterally therefrom. The beam is subjacent to a medial portion of the landing plate and secured thereto by bolts or welds. One edge of the landing plate is adapted to be resting on the roof for added stability.

The placement of the landing assembly, together with the two point support of the landing plate, provides a safe path from the ladder to the roof, and obviates the need to swing one's weight in unsupported fashion beyond the ladder rail. The assembly is easily removed and installed in the field, so that an individual may secure the landing assembly at the proper height while standing on the ladder.

THE DRAWING

DESCRIPTION OF THE PREFERRED EMBODIMENT

The present invention generally comprises a landing assembly which is removably secured to a ladder and which provides a safe and easy path from a ladder to a roof surface or the like. The landing assembly includes a landing platform extending to the side of the ladder, and it is adapted to be secured at any height to the ladder according to the demands of the placement of the ladder. Although the invention will be described with reference to its use with a particular form of ladder, it may be appreciated that it is not limited to such use.

Figure 1:
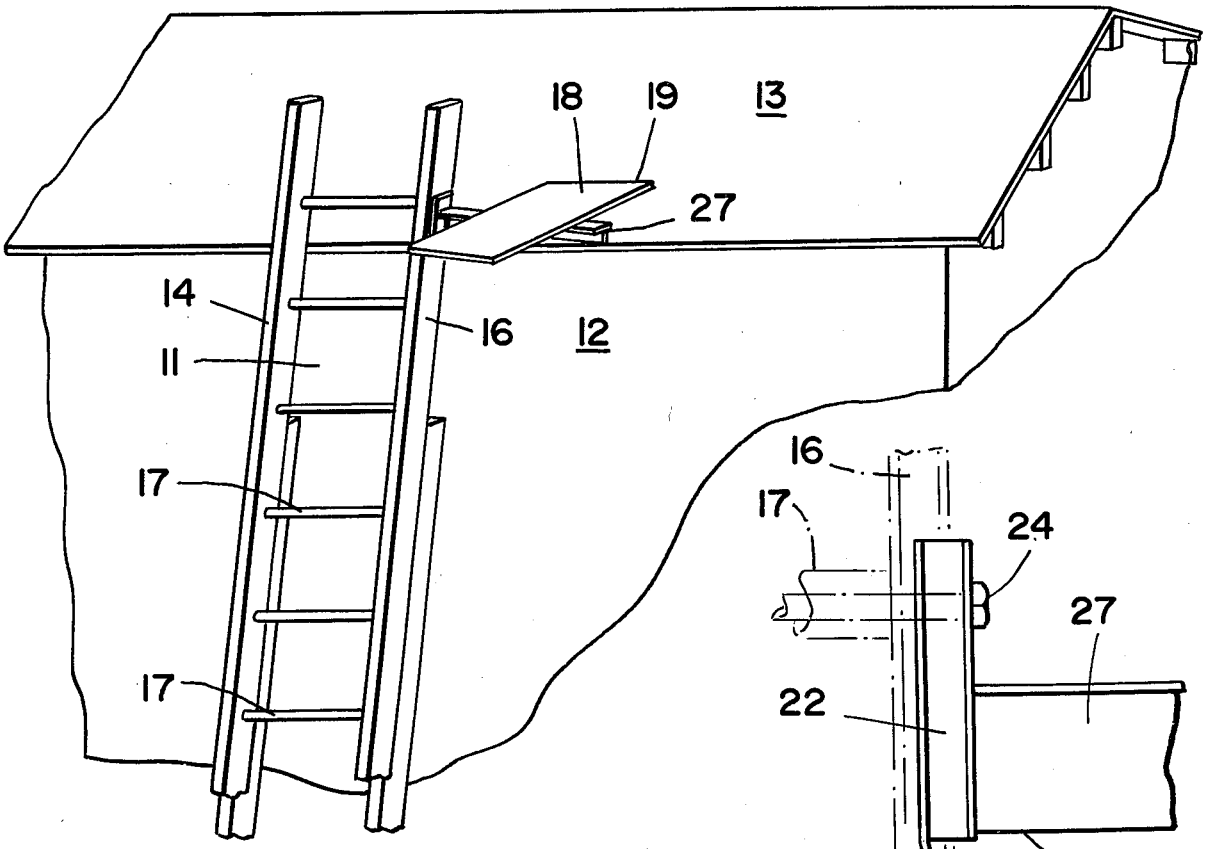
FIG. 1 is a perspective view of the present invention in use.

As shown in FIG. 1, the present invention is used in conjunction with a ladder 11 which is leaning against a building 12 to facilitate gaining access to the roof 13 of the building. In the preferred embodiment the ladder comprises a pair of opposed side rails 14 and 16, each of which constitutes a channel member fabricated of aluminum or the like. Extending between the side rails and spaced equally therealong are a plurality of hollow tubular rungs 17. Such ladder construction is commonly known and forms no part of the present invention.

The landing assembly of the present invention includes a landing platform 18 disposed at one side of the ladder, extending generally horizontally and obliquely to the plane of the ladder rails. One edge 19 of the landing platform is adapted to rest on the roof 13 of the building, and a medial portion of the platform is suppoted subjacently by a support bracket 21 which is secured to the ladder.

Figure 3:
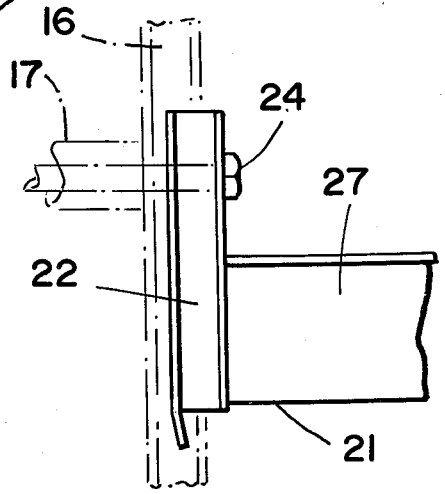
FIG. 3 is a detailed front view of the support bracket of the present invention.
Figure 4:
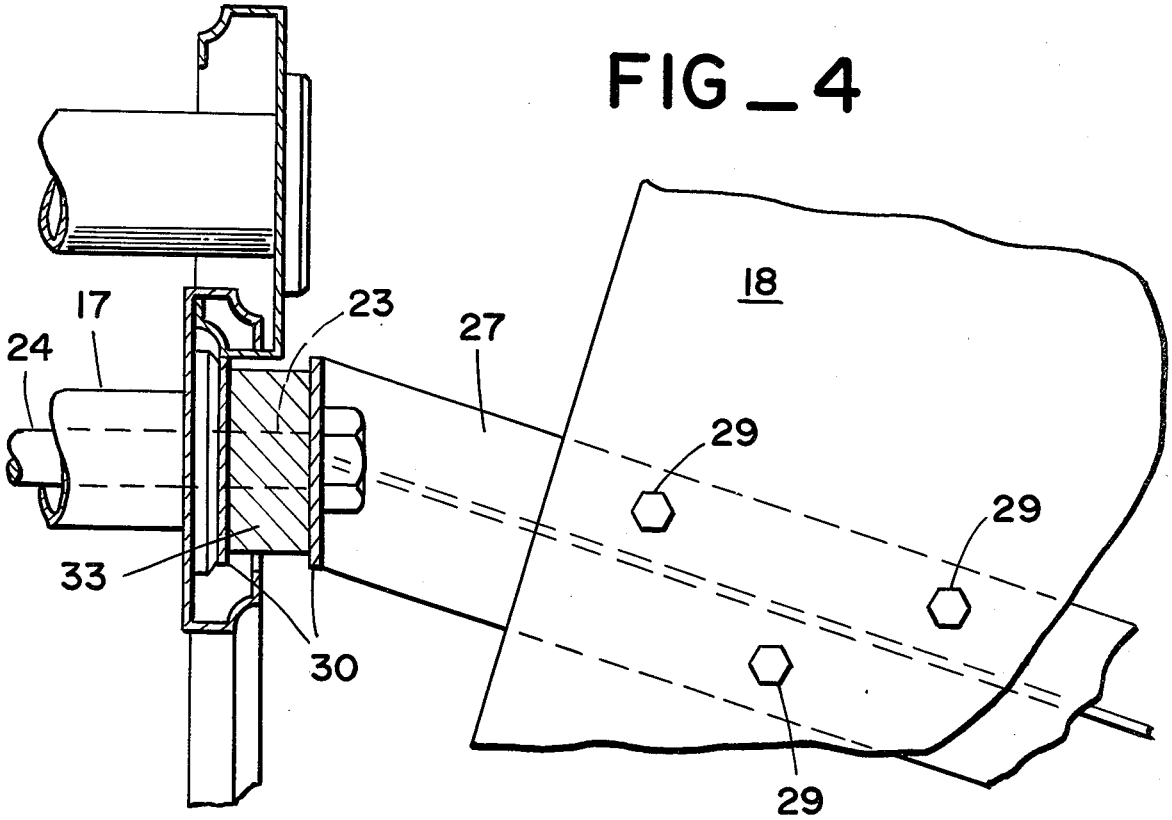
FIG. 4 is a partially cutaway top view of the support bracket of the present invention.
Figure 5:
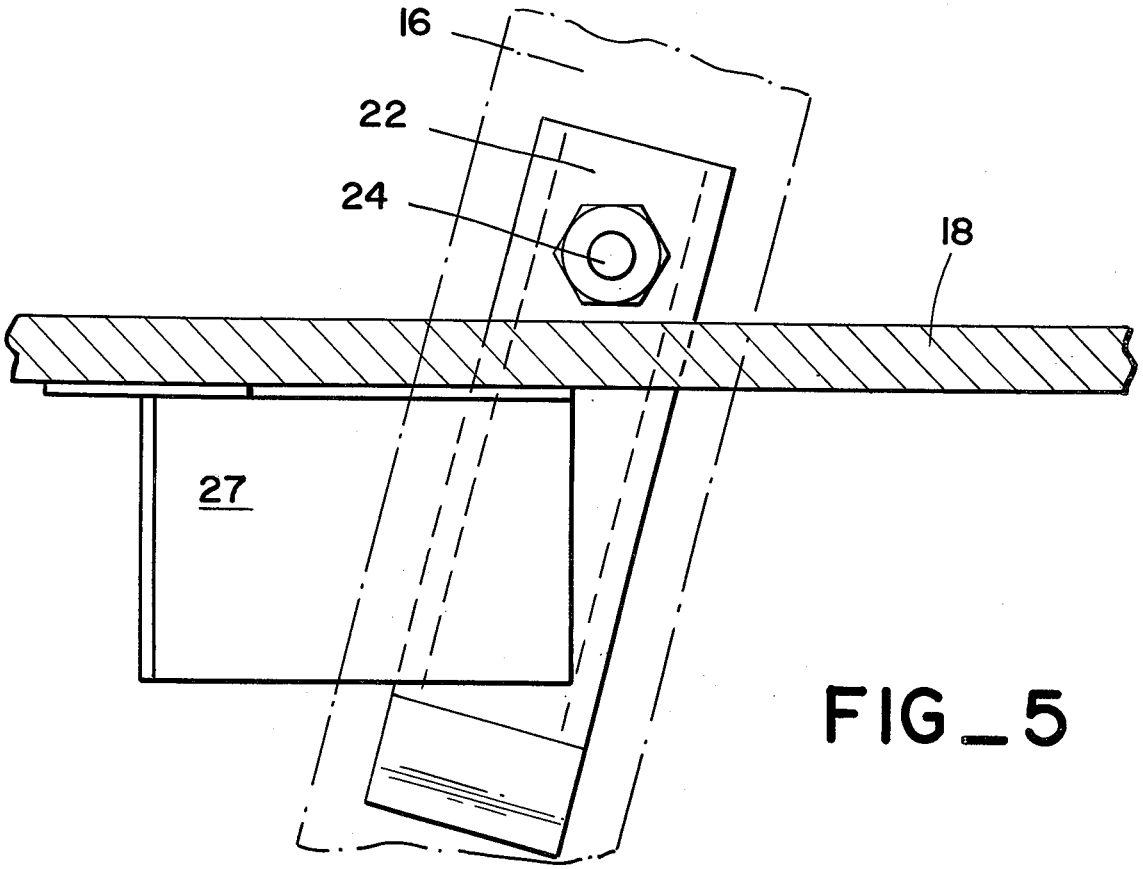
FIG. 5 is a detailed side view of a portion of the present invention.

As shown in FIGS 3, 4, and 5, the support bracket 21 includes a generally upstanding bar member 22 which is adapted to be disposed within the channel cavity of the ladder rail 14 or 16. A hole 23 is provided in the upper end of the bar 22 and is aligned with one of the hollow rungs 17 of the ladder. A tie bar 24 extends through the hole 23 and the rung 17, and is secured adjacent to the other ladder rail by a nut 26. The engagement of the bar within the channel cavity, together with the tie bar secures the bar rigidly in place, yet the bar is easily removed and reinstalled as required.

Figure 2:
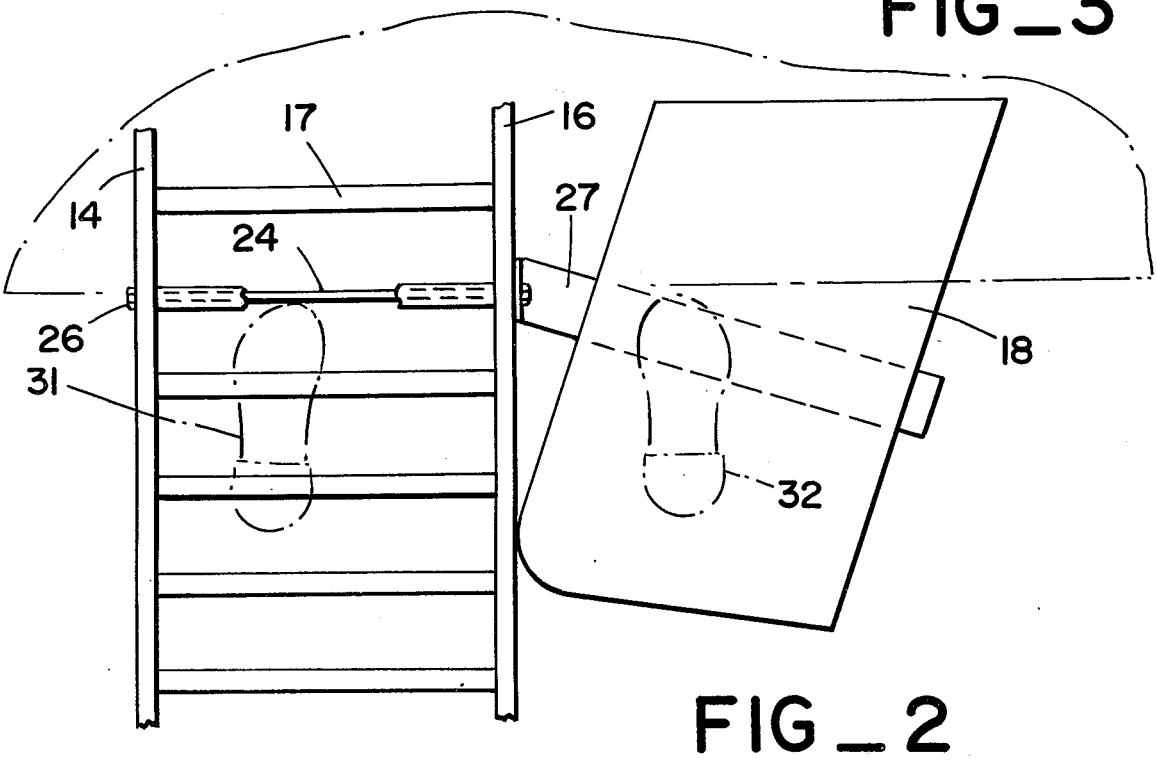
FIG. 2 is a top view of the present invention secured to a ladder.

A support beam 27, which in the preferred embodiment comprises a T beam, is welded or otherwise secured to the bar member 22. The support beam extends laterally from the beam and obliquely from the plane of the ladder rails, as shown in FIG. 2. The upper surface of the support beam, which is canted approximately 15° with respect to the bar 22 to approximate horizontal disposition, is secured to the lower medial surface of the landing platform in a supporting relationship by bolts 29.

The bar member 22 comprises a pair of spaced plates 30 with a wood spacer block 33 sandwiched therebetween. This assembly is joined by a rivet passing therethrough (not shown).

With reference to FIG. 2, it may be appreciated that as a person ascends the ladder which is leaning against a building and attempts to leave the ladder and gain access to the roof, the person must normally lean to one side of the ladder and reach with one foot to gain a footing on the roof. At this point the individual is risking severe injury through an accident caused by missed footing, or by the ladder being driven laterally by the foot still resting thereon.

The landing assembly of the present invention alleviates this problem by providing a safe place to step off of the ladder. With one foot remaining on the ladder (shown in phantom line at 31) the other foot is placed on the landing platform 18, as shown in phantom line at 32. The footing thus provided is much more secure, since the landing platform is supported both by the ladder and the roof. The weight of the individual will not drive the ladder to slide laterally, and will continue to be well supported as the individual ascends to the roof. These same qualities also aid in facilitating descending from the roof to the ladder.

For those ladders which do not include channel configured rails, the bar member 22 may also include laterally disposed arms or the like to provide lateral engagement of the ladder rail. It may be appreciated that the light weight of the landing assembly, together with its simple manner of installation and removal, provide a rugged landing which can easily be assembled to the ladder as required by the ladder orientation and the height of the roof of the building.

I claim:

1. In conjunction with a ladder having spaced side rails of channel configuration, a landing assembly comprising a support bracket having a bar member disposed within one channel of one ladder rail and extending longitudinally in a portion thereof, a support beam secured to said bar member and extending therefrom away from said one ladder rail, said support beam extending out of the plane defined by said side rails and generally horizontally, a landing platform secured in superjacent relationship to said support beam and supported thereby, and a tie bar extending through said bar member and said side rails to secure said landing assembly to said ladder.

2. The landing assembly of claim 1, wherein said tie bar extends through a hollow rung and through both of said side rails, and further including threaded means for securing the distal end of said tie bar in releasable fashion to said ladder.

* * * * *